US010247067B2

(12) United States Patent
May et al.

(10) Patent No.: US 10,247,067 B2
(45) Date of Patent: Apr. 2, 2019

(54) AUXILIARY OIL CIRCUIT

(71) Applicant: GM GLOBAL TECHNOLOGY OPERATIONS LLC, Detroit, MI (US)

(72) Inventors: Ian A. May, Waterford, MI (US); Scott K. Wilson, Lake Orion, MI (US); Akram R. Zahdeh, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 48 days.

(21) Appl. No.: 15/660,596

(22) Filed: Jul. 26, 2017

(65) Prior Publication Data

US 2019/0032527 A1 Jan. 31, 2019

(51) Int. Cl.

| | |
|---|---|
| ***F01M 11/06*** | (2006.01) |
| ***F01M 11/02*** | (2006.01) |
| ***F01M 11/00*** | (2006.01) |
| ***F01M 11/12*** | (2006.01) |

(52) U.S. Cl.

CPC ..... *F01M 11/061* (2013.01); *F01M 11/0004* (2013.01); *F01M 11/02* (2013.01); *F01M 11/12* (2013.01); *F01M 2011/0095* (2013.01)

(58) Field of Classification Search

CPC ..... F01M 11/061; F01M 11/12; F01M 2011/0095; F01M 9/106

See application file for complete search history.

(56) References Cited

U.S. PATENT DOCUMENTS 2,051,706 A * 8/1936 Harris ..... F01M 3/04 123/196 M
4,556,024 A * 12/1985 King ..... F01M 1/10 123/142.5 R
5,947,372 A * 9/1999 Tiernan ..... G01F 23/34 116/227

* cited by examiner

*Primary Examiner* — Jacob Amick

(74) *Attorney, Agent, or Firm* — Quinn IP Law

(57) ABSTRACT

An auxiliary oil circuit for a heat-generating assembly having a main oil sump and a fluid pump for controlling oil flow from the sump includes a first fluid passage in communication with the pump. The circuit additionally includes a remote reservoir for receiving sump oil via the first passage and an orifice in the first passage for controlling an amount of sump oil transferred to the reservoir. The circuit additionally includes an active first valve in the first fluid passage for selectively opening and closing communication between the sump and the reservoir. The circuit also includes a second fluid passage in communication with the auxiliary reservoir for returning the oil from the reservoir to the sump. Furthermore, the circuit includes an active second valve arranged in the second passage for selectively opening and closing communication between the reservoir and the sump.

16 Claims, 4 Drawing Sheets

AUXILIARY OIL CIRCUIT

INTRODUCTION

The disclosure relates to an auxiliary oil circuit for a heat-generating assembly, such as an internal combustion engine or a transmission assembly, employed in a motor vehicle.

In heat-generating assemblies employed in motor vehicles, heat energy is typically generated as a result of internal combustion (in engines) and friction (in engines and transmissions). Oil circulation through such heat-generating assemblies is employed to ensure continuous and reliable operation thereof. The flow of oil within such heat-generating assemblies is generally controlled to lubricate and cool moving components and actuate various subsystems contained therein.

A representative heat-generating assembly typically includes a sump configured to store such oil, as well as a hydraulic pump configured to provide desired amounts of the oil to various components and subsystems of the subject assembly. The sump volume must contain a sufficient amount of oil to maintain an inlet to the hydraulic pump submerged even when some oil is in transit between the assembly's operational components and the sump volume. Consequently, the initial sump fill must be at a sufficient level to account for the oil in transit, while maintaining the inlet of the hydraulic pump covered or submerged at all times. As a result, the overall amount of oil contained within the heat-generating assembly may take an extended amount of time to bring up to operating temperature at which the oil exhibits its best lubrication properties.

SUMMARY

One embodiment of the disclosure is directed to an auxiliary oil circuit for a heat-generating assembly. The heat-generating assembly includes a main oil sump configured to hold oil and a fluid pump in fluid communication with and configured to control a flow of the oil from the main oil sump for lubrication and cooling of the heat-generating assembly. The auxiliary oil circuit includes a first fluid passage in fluid communication with the fluid pump. The auxiliary oil circuit additionally includes an auxiliary reservoir arranged remotely from the heat-generating assembly and configured to receive at least a portion of the oil from the main oil sump via the first fluid passage. The auxiliary oil circuit also includes an orifice arranged in the first fluid passage and configured to control an amount of oil transferred from the main oil sump to the auxiliary reservoir. The auxiliary oil circuit additionally includes an active first valve arranged in the first fluid passage and configured to selectively open and close fluid communication between the main oil sump and the auxiliary reservoir. The auxiliary oil circuit also includes a second fluid passage in fluid communication with the auxiliary reservoir and configured to return the oil from the auxiliary reservoir to the main oil sump. Furthermore, the auxiliary oil circuit includes an active second valve arranged in the second fluid passage and configured to selectively open and close fluid communication between the auxiliary reservoir and the main oil sump.

The auxiliary oil circuit may also include an electronic controller programmed to regulate an oil level in the auxiliary reservoir via regulation of the active first and second valves.

The active first valve may include a first solenoid in electronic communication with the controller.

The active second valve may include a second solenoid in electronic communication with the controller.

The electronic controller may include an internal clock. The electronic controller may be programmed to detect a time to fill the auxiliary reservoir via the internal clock and use the detected time to regulate the oil level in the auxiliary reservoir.

The auxiliary reservoir may include an oil level detector configured to detect the oil level in the auxiliary reservoir and communicate the detected oil level to the electronic controller.

The oil level detector may be a float sensor. Alternatively, the oil level detector may be a laser sensor.

The active first valve may be normally closed and the active second valve may be normally open.

The auxiliary reservoir may include an overflow fluid passage in fluid communication with the main oil sump.

Another embodiment of the present disclosure is directed to a motor vehicle employing a heat-generating assembly and an auxiliary oil circuit, such as described above.

The heat-generating assembly may be a powerplant configured to generate a powerplant torque.

The motor vehicle may include a drive wheel. In such a case, the heat-generating assembly may be a transmission assembly configured to transmit a drive torque to the drive wheel for propelling the motor vehicle.

The above features and advantages, and other features and advantages of the present disclosure, will be readily apparent from the following detailed description of the embodiment(s) and best mode(s) for carrying out the described disclosure when taken in connection with the accompanying drawings and appended claims.

DETAILED DESCRIPTION

Figure 1:
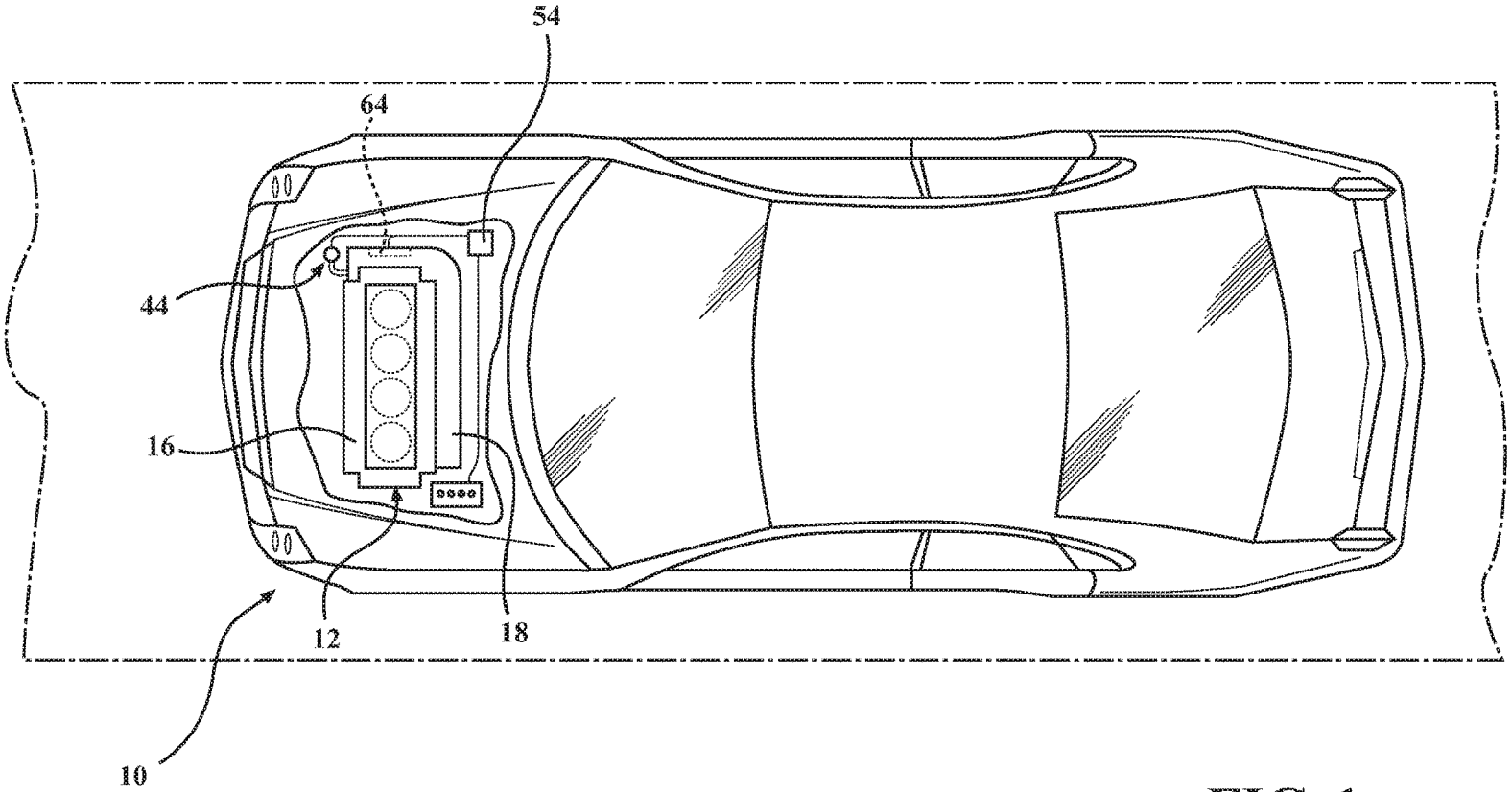
FIG. 1 is a schematic partially sectioned top view of a vehicle having internal combustion engine and transmission assembly embodiments of a heat-generating assembly, wherein the engine is operatively connected to an auxiliary oil circuit, according to the disclosure.

Referring to the drawings, wherein like reference numbers correspond to like or similar components throughout the several figures, FIG. 1 illustrates a vehicle 10 employing a powertrain 12 for propulsion thereof via driven wheels 14. As shown, the powertrain 12 includes an internal combustion engine 16, such as a spark- or compression-ignition type, and a transmission assembly 18 operatively connected thereto. The powertrain 12 may also include one or more electric motor/generators, none of which are shown, but the existence of which may be envisioned by those skilled in the art. Each of the above noted subsystems, as well as other assemblies that generate heat energy in the process or as a byproduct of respective operation. Accordingly, such subsystems maybe defined as heat-generating assemblies. To ensure consistent and reliable operation, such heat-generating assemblies are typically lubricated and cooled by a specially-formulated oil. Although the term "heat-generating assembly" is intended to denote each of the above subassemblies, for conciseness, the remainder of the present disclosure will concentrate on the internal combustion engine 16 as a representative heat-generating assembly.

Figure 2:
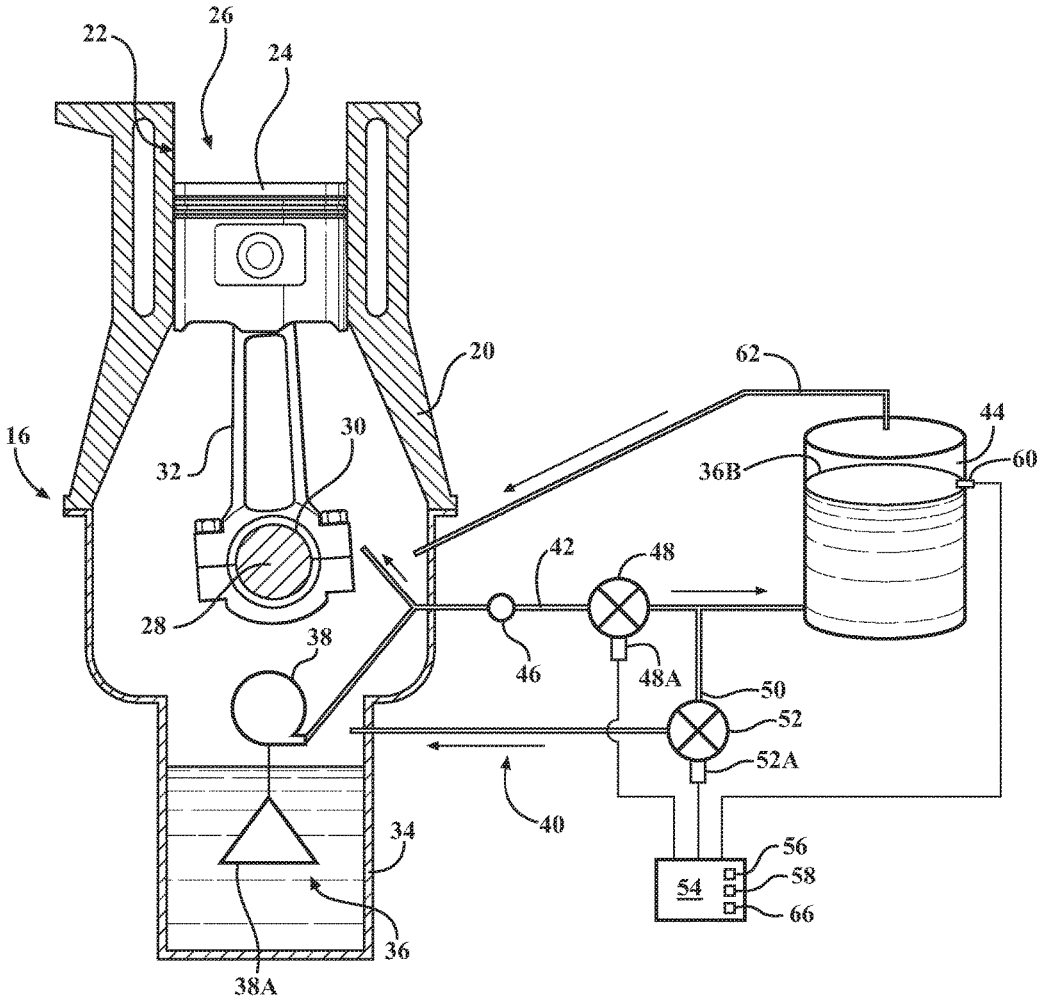
FIG. 2 is a schematic partially cross-sectional plan view of the engine shown in FIG. 1 with the auxiliary oil circuit operating in a specific mode during a first operating period of the engine.
Figure 3:
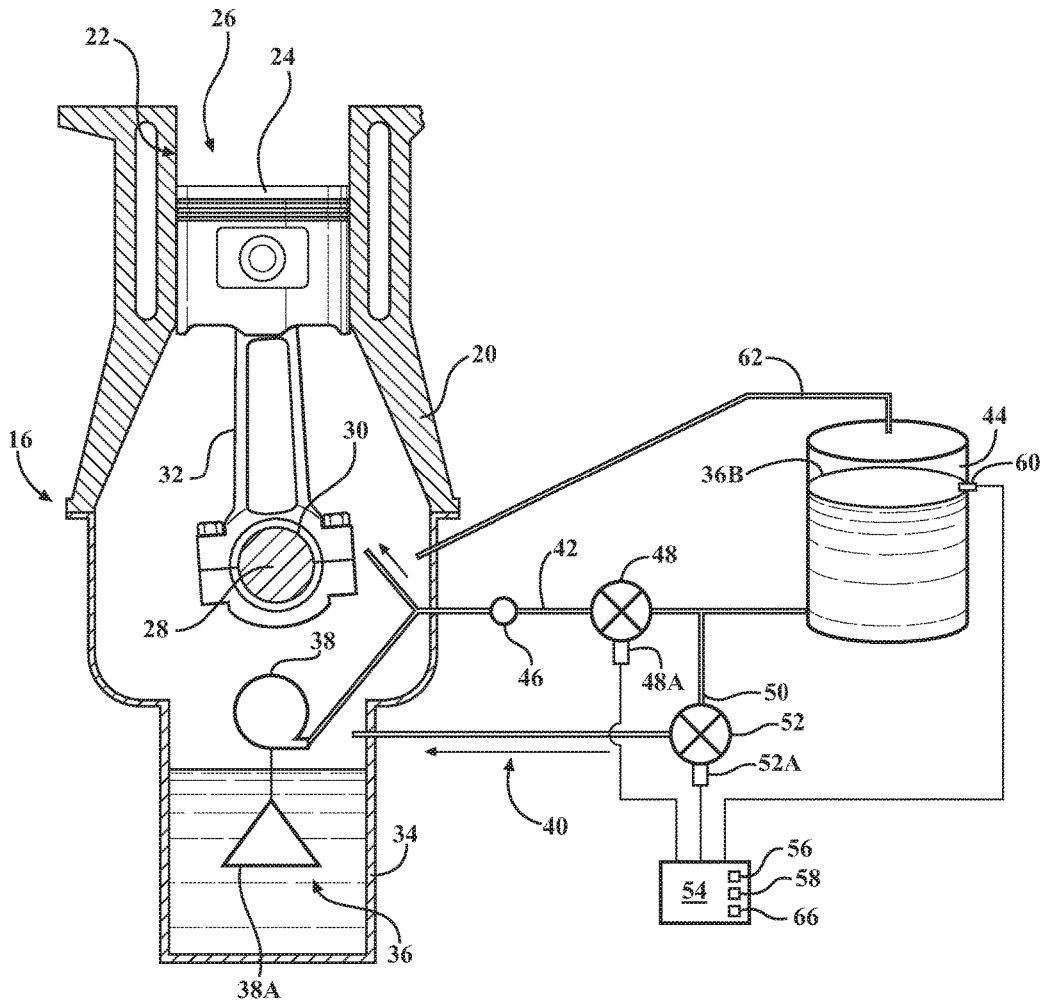
FIG. 3 is a schematic partially cross-sectional plan view of the engine shown in FIG. 1 with the auxiliary oil circuit operating in a specific mode during a second operating period of the engine.
Figure 4:
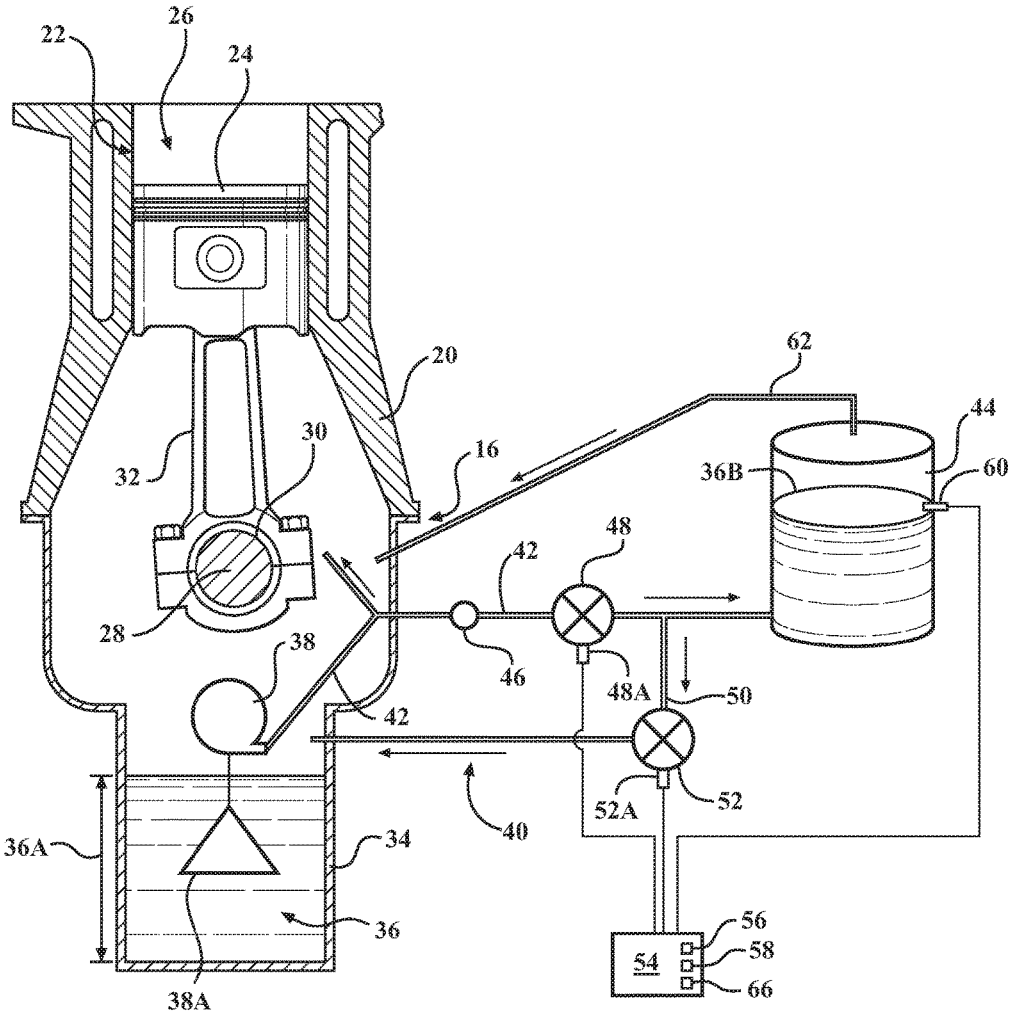
FIG. 4 is a schematic partially cross-sectional plan view of the engine shown in FIG. 1 with the auxiliary oil circuit operating in a specific mode during a third operating period of the engine.

As shown in FIGS. 2-4, the engine 16 includes a cylinder block 20 defining a plurality of cylinders 22. Each cylinder 22 includes a piston 24 configured to reciprocate therein. Each of the cylinders 22 receives fuel and air for subsequent combustion inside a combustion chamber 26 established at the top of a respective piston. The engine 16 also includes a crankshaft 28 configured to rotate on bearings 30 within the cylinder block 20. Each piston 24 is rotatably mounted via a connecting rod 32 on a respective bearing 34 to the crankshaft 28. The crankshaft 28 is rotated by the pistons 24 and generates a torque output of the engine 16 as a result of an appropriately proportioned fuel-air mixture being burned in the respective combustion chambers 26. After the fuel-air mixture is burned inside a specific combustion chamber 26, the reciprocating motion of a particular piston 24 serves to exhaust post-combustion gasses from the respective cylinder 22. As a by-product of generating torque and due to friction at various bearings and sliding surfaces, the engine 16 typically generates heat energy that is subsequently removed and transferred or distributed by engine oil, as well as, in majority of cases, engine coolant. Although an in-line four-cylinder engine 16 is shown, nothing precludes the present disclosure from being applied to an engine having a different number and/or arrangement of cylinders.

The engine 16 also includes a main oil sump 34 mounted to the cylinder block 20 and configured to hold the engine oil 36. Engine oil 36 is generally derived from petroleum-based and non-petroleum synthesized chemical compounds and mainly use base oils composed of hydrocarbons that are blended with chemical additives to minimize friction and wear of engine internal components. Because the oil 36 typically exhibits its best lubrication properties in a specific temperature range, the oil is generally formulated such that its best properties are provided during normal engine operating temperatures. As shown in FIGS. 2-4, a fluid pump 38 is mounted to the cylinder block 20. The oil pump 38 is in fluid communication with and configured to collect the engine oil 36 from the sump 34 for controlling flow and circulation of the oil 36 throughout the engine 16 to cool and/or lubricate critical areas and components, such as the combustion chambers 26 and various bearings, such as 30 and 34 of the engine 16. Following such circulation throughout the engine 16, generally, the engine oil 36 is returned to the sump 34 by gravity. Other heat-generating assemblies, such as noted above, would also include various bearings and bearing surfaces that experience friction and heat build-up, and thus require cooling by appropriate oil held in a respective sump and circulated by a respective fluid pump.

The sump 34 is generally filled with a sufficient amount of the oil 36 to maintain an inlet 38A to the fluid pump 38 submerged even when some of the oil is in transit between the engine's operational components and the sump volume. Accordingly, the initial sump oil fill is generally set at a sufficient level 36A to account for the oil 36 in transit, while maintaining the pump inlet 38A consistently covered or submerged, including during vehicle 10 dynamic maneuvers, such as cornering. As a result, when the engine 16 is started from cold, the overall amount of oil contained within the engine may take an extended amount of time to bring up to operating temperature at which the oil exhibits its best lubrication properties. Similar considerations generally also apply to other, above-referenced, heat-generating assemblies.

As shown in FIGS. 2-4, the vehicle 10 also includes an auxiliary oil circuit 40 for the engine 16. The auxiliary oil circuit 40 includes a first fluid passage 42 in fluid communication with the fluid pump 38. The auxiliary oil circuit 40 also includes an auxiliary reservoir 44 arranged remotely from the engine 16, but in fluid communication with the fluid pump 38. The auxiliary reservoir 44 is configured to receive at least a portion of the oil 36 from the sump 34 via the first fluid passage 42. An orifice 46 is arranged in the first fluid passage 42 and configured to control an amount of the oil 36 transferred from the sump 34 to the auxiliary reservoir 44. The size of the orifice 46 may be calibrated according to specific operating parameters of the heat-generating assembly, such as the engine 16, and the desired rate of increase in the temperature of the oil 36 during the assembly's warm-up period or phase.

An active first valve 48 is arranged in the first fluid passage 42 and configured to selectively open and close fluid communication between the pump 38 and the auxiliary reservoir 44. A second fluid passage 50 is in fluid communication with the auxiliary reservoir 44. As specifically shown, the second fluid passage 50 is in fluid communication with the first fluid passage 42 between the active first valve 48 and the auxiliary reservoir 44. The second fluid passage 50 is configured to return the oil 36 from the auxiliary reservoir 44 to the sump 34. An active second valve 52 is arranged in the second fluid passage 50 and configured to selectively open and close fluid communication between the auxiliary reservoir 44 and the sump 34.

As shown in FIGS. 1-4, the vehicle 10 additionally includes an electronic controller 54. The controller 54 may be an electronic control module (ECM) or a powertrain controller, for example, configured to regulate operation of the engine 16, the transmission 18, and other heat-generating assemblies. The controller 54 includes a memory, at least some of which is tangible and non-transitory. The memory may be a recordable medium that participates in providing computer-readable data or process instructions. Such a medium may take many forms, including but not limited to non-volatile media and volatile media. Non-volatile media for the controller 54 may include, for example, optical or magnetic disks and other persistent memory. Volatile media may include, for example, dynamic random access memory (DRAM), which may constitute a main memory. Such instructions may be transmitted by one or more transmission medium, including coaxial cables, copper wire and fiber optics, including the wires that comprise a system bus coupled to a processor of a computer.

Memory of the controller 54 may also include a flexible disk or a hard disk, magnetic tape, other magnetic medium, a CD-ROM, DVD, other optical medium, etc. The controller 54 may be configured or equipped with other required computer hardware, such as an internal high-speed clock 56, requisite Analog-to-Digital (A/D) and/or Digital-to-Analog (D/A) circuitry, input/output circuitry and devices (I/O), as well as appropriate signal conditioning and/or buffer circuitry. Algorithms required by the controller 54 or accessible thereby may be stored in the memory and automatically executed to provide the required functionality. The controller 54 may be part of the auxiliary oil circuit 40 and programmed to regulate operation thereof.

Specifically, the controller 54 may be programmed to regulate an oil level 36B in the auxiliary reservoir 44 via regulation of the first and second valves 48, 52. As shown in FIGS. 1-4, the active first valve 48 may include a first solenoid 48A in electronic communication with the controller 54. Similarly, the active second valve 52 includes a second solenoid 52A in electronic communication with the controller 54. The controller 54 may be programmed to detect a predetermined amount of time 58 to fill the auxiliary reservoir 44 via the internal clock 56. The controller 54 may be additionally programmed use the detected amount of time 58 to regulate the oil level 36B in the auxiliary reservoir 44.

The auxiliary reservoir 44 may include an oil level detector 60 configured to detect the oil level 36B in the auxiliary reservoir. The oil level detector 60 may be configured as a float sensor. Alternatively, the oil level detector 60 may be a laser sensor. Each of such oil level detectors 60 may be configured to communicate the detected oil level to the controller 54 for regulation of the amount of oil being held in the auxiliary reservoir 44. The auxiliary reservoir may additionally include an overflow fluid passage 62 in fluid communication with the sump 34. Such an overflow fluid passage 62 may facilitate return of oil 36 that exceeds some predetermined maximum oil level 36B in the auxiliary reservoir 44. Alternatively, the pump 38 may be configured to pressurize the auxiliary oil circuit 40, such that the volume of oil 36 in the reservoir 44 remains under pressure. The resultant auxiliary source of pressurized oil 36 may then be used to power other subsystems 64 of the engine, such as a camshaft phaser, etc (shown in FIG. 1). Accordingly, the controller 54 may be programmed to route the pressurized oil as required by such a subsystem 64 via appropriate fluid passages (not shown).

The active first valve 48 may be configured as normally closed, while the active second valve 52 may be configured as normally open, when the engine 16 has reached its normal, i.e., prescribed, operating temperature 66. In other words, in such an embodiment, when the engine is fully warm, the controller 54 may be programmed to regulate the first solenoid 48A to maintain the first valve 48 in its closed state, while regulating the second solenoid 52A to open the second valve 52 to return oil 36 from the auxiliary reservoir 44 to the sump 34 (shown in FIG. 4). When the engine 16 is started from cold, the controller 54 may be programmed to regulate the first solenoid 48A to open the first valve 48, while regulating the second solenoid 52A to maintain closure of the second valve 52, and thereby permit collection of some of the oil 36 in the auxiliary reservoir 44 (shown in FIG. 2).

While the engine 16 is operating during its warm-up period, the controller may regulate the first solenoid 48A and the second solenoid 52A to close the respective first and second valves 48, 52 to maintain the diverted oil 36 in the auxiliary reservoir 44, to thereby permit the engine 16 to warm up at a faster rate (shown in FIG. 3). Once the engine 16 has reached its predetermined operating temperature 66, the controller 54 may regulate the first solenoid 48A to close the first valve 48, while regulating the second solenoid 52A to return the second valve 52 to its open state.

Accordingly, the auxiliary oil circuit 40 facilitates regulation of the amount of oil 36 being held in the particular heat-generating assembly, i.e., in the sump 34 and in transit, starting from cold and during the assembly's warm-up period. By regulating the amount of oil 36 being held by the heat-generating assembly, the auxiliary oil circuit 40 may thereby facilitate an increased rate of oil warm-up in the assembly. Furthermore, an appropriate control of the auxiliary oil circuit 40 may permit return of the diverted oil 36 back to the sump 34 when the subject heat-generating assembly has reached its prescribed operating temperature 66.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment may be combined with one or a plurality of other desired characteristics from other embodiments, resulting in other embodiments not described in words or by reference to the drawings. Accordingly, such other embodiments fall within the framework of the scope of the appended claims.

What is claimed is:

1. An auxiliary oil circuit for a heat-generating assembly having a main oil sump configured to hold oil and a fluid pump in fluid communication with and configured to control a flow of the oil from the main oil sump for lubrication and cooling of the heat-generating assembly, the auxiliary oil circuit comprising:

a first fluid passage in fluid communication with the fluid pump;

an auxiliary reservoir arranged remotely from the heat-generating assembly and configured to receive at least a portion of the oil from the main oil sump via the first fluid passage;

an orifice arranged in the first fluid passage and configured to control an amount of oil transferred from the main oil sump to the auxiliary reservoir;

an active first valve arranged in the first fluid passage and configured to selectively open and close fluid communication between the main oil sump and the auxiliary reservoir;

a second fluid passage in fluid communication with the auxiliary reservoir and configured to return the oil from the auxiliary reservoir to the main oil sump;

an active second valve arranged in the second fluid passage and configured to selectively open and close fluid communication between the auxiliary reservoir and the main oil sump; and an electronic controller having an internal clock and programmed to:

detect a time to fill the auxiliary reservoir via the internal clock; and regulate an oil level in the auxiliary reservoir via regulation of the active first and second valves using the detected time.

2. The auxiliary oil circuit of claim 1, wherein the active first valve includes a first solenoid in electronic communication with the controller.

3. The auxiliary oil circuit of claim 1, wherein the active second valve includes a second solenoid in electronic communication with the controller.

4. The auxiliary oil circuit of claim 1, wherein the auxiliary reservoir includes an oil level detector configured to detect the oil level in the auxiliary reservoir and communicate the detected oil level to the electronic controller.

5. The auxiliary oil circuit of claim 4, wherein the oil level detector is a float sensor.

6. The auxiliary oil circuit of claim 4, wherein the oil level detector is a laser sensor.

7. The auxiliary oil circuit of claim 1, wherein the active first valve is normally closed and the active second valve is normally open.

8. The auxiliary oil circuit of claim 1, wherein the auxiliary reservoir includes an overflow fluid passage in fluid communication with the main oil sump.

9. A motor vehicle comprising:

a heat-generating assembly having:

a main oil sump configured to hold oil; and a fluid pump in fluid communication with and configured to control a flow of the oil from the main oil sump for lubrication and cooling of the heat-generating assembly;

a first fluid passage in fluid communication with the fluid pump;

an auxiliary reservoir arranged remotely from the heat-generating assembly and configured to receive at least a portion of the oil from the main oil sump via the first fluid passage;

an orifice arranged in the first fluid passage and configured to control an amount of oil transferred from the main oil sump to the auxiliary reservoir;

an active first valve arranged in the first fluid passage and configured to selectively open and close fluid communication between the main oil sump and the auxiliary reservoir;

a second fluid passage in fluid communication with the auxiliary reservoir and configured to return the oil from the auxiliary reservoir to the main oil sump; and an active second valve arranged in the second fluid passage and configured to selectively open and close fluid communication between the auxiliary reservoir and the main oil sump; and an electronic controller having an internal clock and programmed to:

detect a time to fill the auxiliary reservoir via the internal clock; and regulate an oil level in the auxiliary reservoir via regulation of the active first and second valves using the detected time.

10. The motor vehicle of claim 9, wherein the active first valve includes a first solenoid in electronic communication with the controller.

11. The motor vehicle of claim 9, wherein the active second valve includes a second solenoid in electronic communication with the controller.

12. The motor vehicle of claim 9, wherein the auxiliary reservoir includes an oil level detector configured to detect the oil level in the auxiliary reservoir and communicate the detected oil level to the electronic controller.

13. The motor vehicle of claim 12, wherein the oil level detector is a float sensor.

14. The motor vehicle of claim 12, wherein the oil level detector is a laser sensor.

15. The motor vehicle of claim 9, wherein the active first valve is normally closed and the active second valve is normally open.

16. The motor vehicle of claim 9, wherein the auxiliary reservoir includes an overflow fluid passage in fluid communication with the main oil sump.

* * * * *